US006409554B2

(12) United States Patent
Verneau

(10) Patent No.: US 6,409,554 B2
(45) Date of Patent: Jun. 25, 2002

(54) ELECTRICAL CONNECTION DEVICE FOR DIRECTLY JOINING A CONDUCTOR TO A MALE ELECTRICAL CONTACT MEMBER

(75) Inventor: Olivier Verneau, Rueil Malmaison (FR)

(73) Assignee: SYLEA, Montigny le Bretonneus (FR)

( * ) Notice: Subject to any disclaimer, the term of this patent is extended or adjusted under 35 U.S.C. 154(b) by 0 days.

(21) Appl. No.: 09/866,983

(22) Filed: May 29, 2001

(30) Foreign Application Priority Data

May 30, 2000 (FR) ..... 00 06931

(51) Int. Cl.[7] ..... H01R 4/40
(52) U.S. Cl. ..... 439/786
(58) Field of Search ..... 439/861, 395, 439/396, 397, 877, 879, 891, 607, 609, 786, 725, 835

(56) References Cited

U.S. PATENT DOCUMENTS 2,720,634 A * 10/1955 Hart ..... 439/786
3,283,289 A * 11/1966 Cobaugh ..... 439/786
4,838,816 A * 6/1989 Matsusaka et al. ..... 439/861
5,030,143 A 7/1991 HatagishiI
5,082,461 A * 1/1992 Minnis et al. ..... 439/786
6,168,479 B1 * 1/2001 Canault et al. ..... 439/835

FOREIGN PATENT DOCUMENTS

| | | | |
|---|---|---|---|
| DE | 416 398 | 12/1924 | |
| EP | 0 040 783 | 12/1981 | |
| EP | 0 313 253 | 4/1989 | |
| FR | 2 687 020 | 8/1993 | |
| GB | 2228150 | * 8/1990 | ..... 439/786 |

* cited by examiner

*Primary Examiner*—Neil Abrams
*Assistant Examiner*—J. F. Duverne
(74) *Attorney, Agent, or Firm*—Pearne & Gordon LLP

(57) ABSTRACT

An electrical connection device including a body in the form of a cage having a bearing plate for a bared conductor. The bearing plate has a projection on its inside face and a retaining rim. A curved elastic wall opposite the bearing plate has its convex side facing toward the interior of the cage. In use, a conductor is bent into a U-shape with two branches and a loop, the loop is inserted between the projection and the rim, and the branches then bear against internal lateral walls adjacent the bearing plate.

15 Claims, 3 Drawing Sheets

ELECTRICAL CONNECTION DEVICE FOR DIRECTLY JOINING A CONDUCTOR TO A MALE ELECTRICAL CONTACT MEMBER

BACKGROUND OF THE INVENTION

1. Field of the Invention

The present invention relates to an electrical connection device for a male electrical contact member in the form of a tongue. The invention also relates to a housing member adapted to contain this kind of device.

2. Description of the Prior Art

As a general rule, electrical connection devices for male tongues take the form of a body which is a good conductor of electricity and features a conduit into which the tongue is inserted, the interior of the conduit is conformed to feature a clamp adapted to grip the tongue and the body includes means for fixing it to a previously bared end of a conductor.

This kind of arrangement is relatively complex and necessitates considerable tooling.

A first object of the present invention is to simplify this kind of electrical connection device.

SUMMARY OF THE INVENTION

The invention provides an electrical connection device for a male electrical contact member in the form of a tongue, the device including a body in the form of a cage having an internal lateral wall constituting a bearing plate for a bared conductor, wherein the bearing plate has a projection on its inside face, a retaining rim in the vicinity of the projection and a curved elastic wall opposite the bearing plate with its convex side facing toward the interior of the cage, whereby, in use, the conductor can be bent into a U-shape with two branches and a loop, the loop can be inserted between the projection and the rim, and the branches then bear against internal lateral walls adjacent the bearing plate.

The male tongue is therefore inserted between the part of the conductor bent into a loop and the elastic wall and is pressed against the conductor to make the electrical connection.

This kind of arrangement has many advantages. It suffices to bend the conductor to fit it to the device and crimping is eliminated.

Because the electrical connection is made by the contact of one face of the male tongue with the conductor, the body can be made either from a material that is a good conductor of electricity or from an insulative material, for example a molded plastics material.

According to one constructional feature, the cage is made from a strip cut and bent to form a base with a rectangular section with two longer sides and two shorter sides, one of which shorter sides has an extension partly covering an outside face of a longer side.

According to another constructional feature, the shorter sides of the base are each extended at one end by a retaining lug and free ends of the lugs diverge.

According to another constructional feature, one of the longer sides of the base is extended at the same end as the retaining lugs by the bearing plate which terminates in a rim directed toward the interior of the cage and in which a lancing at an intermediate point of its height forms the projection inside the cage.

According to another constructional feature, the longer side of the base opposite that provided with the bearing plate is extended in the same direction thereas to form an elastic strip having at an intermediate point of its height a bending line delimiting a first part extending from the base toward the interior of the cage and a second part directed toward the outside.

The invention also provides a housing member which has a passage adapted to receive the device and the passage and the device have conjugate means for locking the device into the passage.

It is therefore possible to make junction boxes, fuse boxes or other boxes which include a base member having a certain number of passages each containing a device according to the invention with the corresponding conductor and whose functions can be modified on demand, without having to fabricate new tooling.

According to another constructional feature, the passage has at one end an opening through which the male tongue can be inserted and at the other end an opening through which the conductor can be inserted, the internal lateral walls of the passage have shoulders in the vicinity of the opening against which respective edges of two longer sides of the base of the cage bear, and two other internal lateral walls opposite the passage and in the vicinity of the opening have shoulders against which the free ends of the retaining lugs bear.

The invention will now be described in more detail with reference to one particular embodiment shown by way of example in the appended drawings.

DETAILED DESCRIPTION OF THE PREFERRED EMBODIMENT

Figure 1:
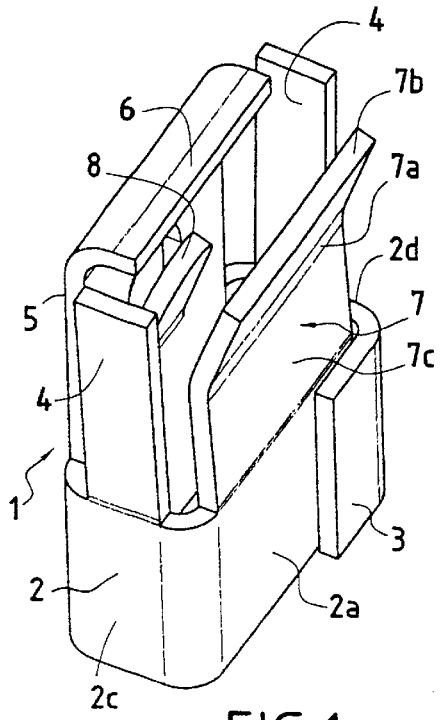
FIGS. 1 and 2 are perspective views of a cage of an electrical connection device according to the invention.
Figure 2:
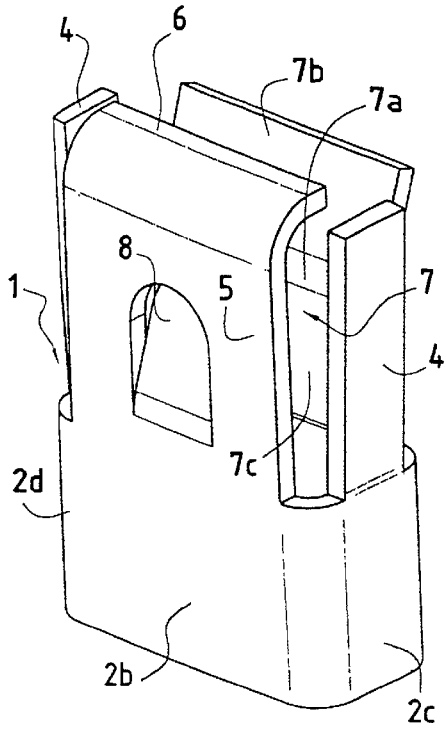
Figure 3:
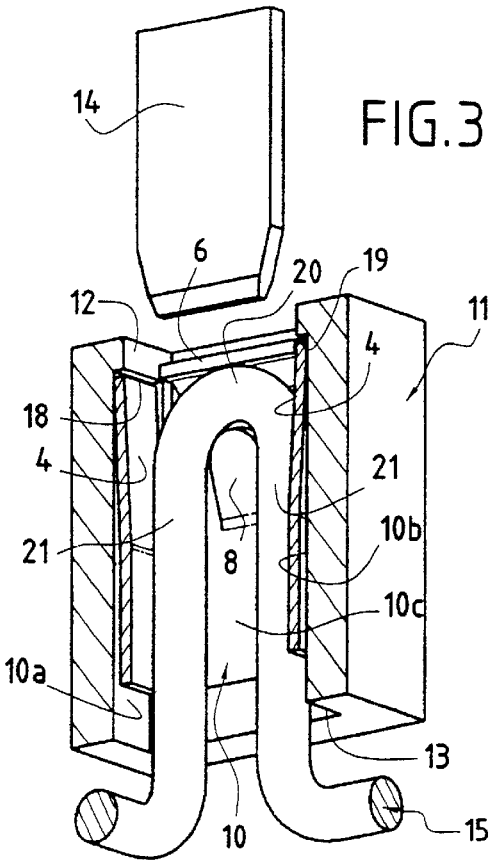
FIGS. 3 and 4 are partly cut-away perspective views of the device inserted in a passage of a housing.
Figure 4:
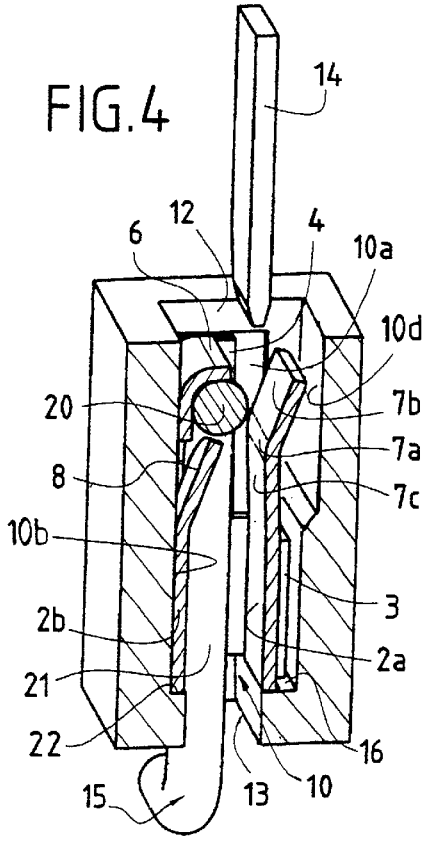
Figure 5:
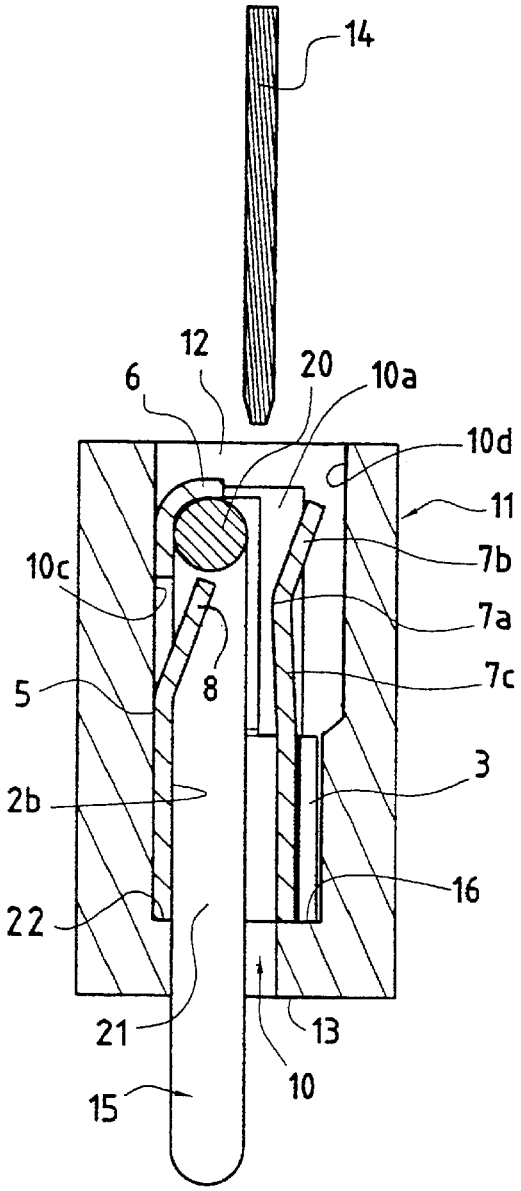
FIGS. 5 and 6 are views in section showing the insertion of a male tongue.

The device according to the invention includes a cage 1 which can be made either from a metal that is a good conductor of electricity and has some elasticity or an elastic insulative material.

The cage 1 is made from a strip that is cut and bent to form a base 2 of rectangular section with two longer sides 2*a* and 2*b* and two shorter sides 2*c* and 2*d*. The shorter side 2*d* has an extension 3 covering a part of the longer side 2*a*.

Each shorter side 2*c* and 2*d* is extended by a retaining lug 4 that is bent slightly so that the lugs extend away from each other toward a free end.

At the same end as the retaining tongues 4, the longer side 2*b* is extended by a bearing plate 5 which terminates in a rim 6. A lancing delimits a projection 8 inside the cage at an intermediate point of the bearing plate 5.

At the same end as the retaining tongues 4, the longer side 2*a* is extended by an elastic strip 7 which has two parts 7*b* and 7*c* delimited by a bending line 7*a*. The part 7*c* extends toward the inside of the cage and the part 7*b* toward the outside. The bending line 7*a* is convex on the inside of the cage.

The cage 1 is designed to be inserted into a passage 10 of a housing member 11 (see FIGS. 3, 4, 7 and 8). The passage has four internal lateral walls 10*a*, 10*b*, 10*c* and 10*d* and an opening 12 at one end for inserting a male tongue 14. Its other end has an opening 13 for inserting a conductor 15.

Near the opening 13 the internal lateral wall 10*d* is conformed with a shoulder 16 against which bear the edge of the extension 3 and the corresponding edge of the longer side 2*a*. Near the opening 12 the internal lateral walls 10*a* and 10*b* have respective abutments 18 and 19 against which bear the free ends of the retaining lugs 4. Near the opening 13 the internal lateral wall 10*b* has a shoulder 22 against which bears the corresponding edge of the longer side 2*b*. The cage 1 can therefore be mounted in the passage 10 through the opening 12, subject to elastic deformation of the retaining lugs 4. In conjunction with the extension 3 of the edge of the longer side 2*a* and the lugs 4, the shoulders 16 and 22 and the abutments 18 and 19 lock the cage 1 into the passage 10.

As shown in FIGS. 3, 4, 5 and 6, the conductor 15 is mounted in the cage 1 to form a loop 20 with two branches 21 which is immobilized by the rim 6 and by the projection 8. To pass them through the opening 13, the branches 21 are pressed against the base 2.

Figure 6:
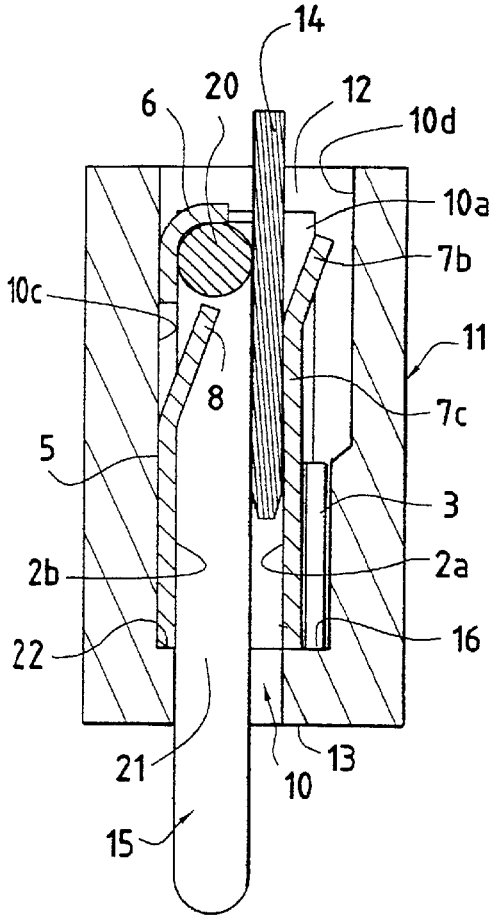

The tongue 14 is passed through the opening 12 and inserted between the conductor 15 and the internal face of the elastic strip 7, which presses the tongue 14 against the conductor 15 (see FIG. 6). This makes the electrical connection between the tongue 14 and the conductor 15. This electrical connection can be complemented by the cage itself if it is made from an electrically conductive material.

Figure 7:
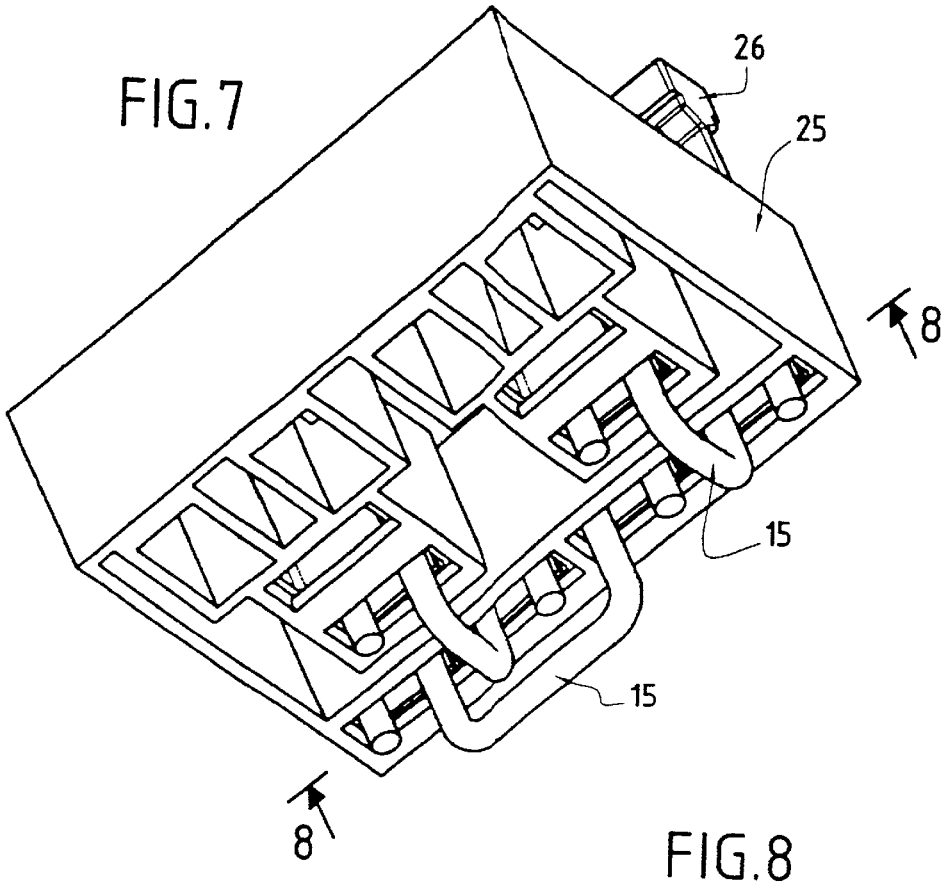
FIG. 7 is a perspective bottom view of a fuse box employing the device according to the invention.
Figure 8:
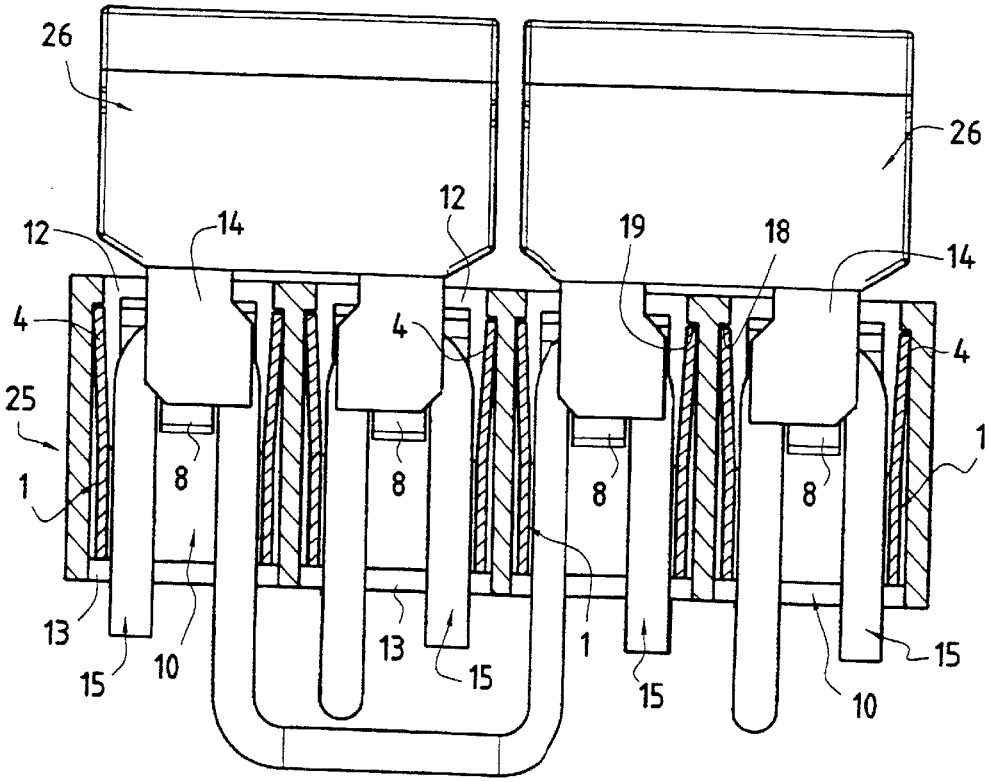
FIG. 8 is a view in section taken along the line 8—8 in FIG. 7.

FIGS. 7 and 8 show one example of the use of the device according to the invention in a fuse box.

The fuse box 25 includes a series of passages 10 each of which houses a cage 1. Conductors 15 are mounted in the cages in the manner explained above. In this example the tongues 14 are part of fuses 26.

Thanks to the invention, starting with a box 25, it is possible to insert cages 1 in the passages of the box according to the required configuration and the configuration of the cages can be modified without having to fabricate new tooling, which is particularly economical.

Of course, the invention is not limited to the embodiment just described and shown, to which many modifications of detail can be made without departing from the scope of the invention.

CROSS-REFERENCE TO RELATED APPLICATIONS

The instant application is based upon French priority Patent Application No. 00.06931, filed May 30, 2000, the disclosure of which is hereby incorporated by reference thereto in its entirety, and the priority of which is hereby claimed under 35 U.S.C. §119.

There is claimed:

1. An electrical connection device for a male electrical contact member in the form of a tongue, said device including a body in the form of a cage having an internal lateral wall constituting a bearing plate for a bared conductor, wherein said bearing plate has a projection on its inside face, a retaining rim in the vicinity of said projection and a curved elastic wall opposite said bearing plate with its convex side facing toward the interior of said cage, whereby, in use, said conductor can be bent into a U-shape with two branches and a loop, said loop can be inserted between said projection and said rim, and said branches then bear against internal lateral walls adjacent said bearing plate.

2. The device claimed in claim 1 wherein said cage is made from an insulative material.

3. The device claimed in claim 1 wherein said cage is made from an elastic material that is a good conductor of electricity.

4. The device claimed in claim 1 wherein said cage is made from a strip cut and bent to form a base with a rectangular section with two longer sides and two shorter sides, one of which shorter sides has an extension partly covering an outside face of a longer side.

5. The device claimed in claim 4 wherein said shorter sides of said base are each extended at one end by a retaining lug and free ends of said lugs diverge.

6. The device claimed in claim 4 wherein one of said longer sides of said base is extended at the same end as said retaining lugs by said bearing plate which terminates in a rim directed toward the interior of said cage and in which a lancing at an intermediate point of its height forms said projection inside said cage.

7. The device claimed in claim 4 wherein said longer side of said base opposite that provided with said bearing plate is extended in the same direction thereas to form an elastic strip having at an intermediate point of its height a bending line delimiting a first part extending from said base toward the interior of said cage and a second part directed toward the outside.

8. A housing member adapted to receive an electrical connection device for a male electrical contact member in the form of a tongue, said device including a body in the form of a cage having an internal lateral wall constituting a bearing plate for a bared conductor, wherein said bearing plate has a projection on its inside face, a retaining rim in the vicinity of said projection and a curved elastic wall opposite said bearing plate with its convex side facing toward the interior of said cage, whereby, in use, said conductor can be bent into a U-shape with two branches and a loop, said loop can be inserted between said projection and said rim, and said branches then bear against internal lateral walls adjacent said bearing plate, which housing member is provided with a passage adapted to receive said device and wherein said passage and said device have conjugate means for locking said device into said passage.

9. The housing member claimed in claim 8 wherein said cage is made from an insulative material.

10. The housing member claimed in claim 8 wherein said cage is made from an elastic material that is a good conductor of electricity.

11. The housing member claimed in claim 8 wherein said cage is made from a strip cut and bent to form a base with a rectangular section with two longer sides and two shorter sides, one of which shorter sides has an extension partly covering an outside face of a longer side.

12. The housing member claimed in claim 11 wherein said shorter sides of said base are each extended at one end by a retaining lug and free ends of said lugs diverge.

13. The housing member claimed in claim 11 wherein one of said longer sides of said base is extended at the same end as said retaining lugs by said bearing plate which terminates in a rim directed toward the interior of said cage and in which a lancing at an intermediate point of its height forms said projection inside said cage.

14. The housing member claimed in claim 11 wherein said longer side of said base opposite that provided with said bearing plate is extended in the same direction thereas to form an elastic strip having at an intermediate point of its height a bending line delimiting a first part extending from said base toward the interior of said cage and a second part directed toward the outside.

15. The housing member claimed in claim 8 wherein said passage has at one end an opening through which said male tongue can be inserted and at the other end an opening through which said conductor can be inserted, said internal lateral walls of said passage have shoulders in the vicinity of said opening against which respective edges of two longer sides of said base of said cage bear, and two other internal lateral walls opposite said passage and in the vicinity of said opening have shoulders against which said free ends of said retaining lugs bear.

* * * * *